United States Patent [19]

Sonnleitner

[11] Patent Number: 4,865,296

[45] Date of Patent: Sep. 12, 1989

[54] LADLE SLAGGING STAND

[75] Inventor: Rudolf Sonnleitner, Frohnleiten, Austria

[73] Assignee: Voest-Alpine Industrienlegenbau Gessellschaft, Linz, Austria

[21] Appl. No.: 209,546

[22] Filed: Jun. 21, 1988

[30] Foreign Application Priority Data

Jun. 22, 1987 [AT] Austria ..... 1568/87

[51] Int. Cl.[4] ..... C21C 5/38

[52] U.S. Cl. ..... 266/142; 266/158; 266/228

[58] Field of Search ..... 266/142, 158, 159, 228, 266/227; 373/8, 9

[56] References Cited

U.S. PATENT DOCUMENTS

| | | | |
|---|---|---|---|
| 4,168,824 | 9/1979 | Nagati | 266/158 |
| 4,243,208 | 1/1981 | Laimer | 266/158 |
| 4,410,166 | 10/1983 | Hixenbaugh et al. | 266/158 |

*Primary Examiner*—S. Kastler

*Attorney, Agent, or Firm*—Hopgood, Calimafde, Kalil, Blaustein & Judlowe

[57] ABSTRACT

A ladle slagging stand includes a tilting arrangement supporting a ladle, a slag vessel, and a slagging slide scumming the surface of the melt in the ladle placed on the tilting arrangement. In order to be able to seize all the gas and dust emissions forming during the slagging procedure, both the tilting means and the slagging slide, and the slag vessel are surrounded by a casing into which a suction duct enters. The casing includes at least one closable opening for introducing and removing the ladle and the slag vessel.

6 Claims, 2 Drawing Sheets

LADLE SLAGGING STAND

The invention relates to a ladle slagging stand comprising a tilting means supporting a ladle, a slag vessel, and a slagging slide scumming the surface of the melt in the ladle placed on the tilting means.

A ladle slagging stand of this type is known from German Offenlegungsschrift No. 2,250,695. In order to remove the slag in this known ladle slagging stand, the ladle, which is arranged above the slag vessel, is inclined and the slag floating on the metal melt is moved over the rim of the ladle by means of the slagging slide, the slag, thus, flowing into the slag vessel. This procedure involves intensive dust and flue gas generation.

In order to seize these flue gases, it is internally known to arrange a gas exhaust hood above the slag vessel. In doing so, it is disadvantageous that the gas exhaust hood, which has to be positioned closely above the slag vessel in order to be somewhat effective, must be provided with a passage opening for the slag drawn off. Hence, considerable amounts of false air must additionally be sucked off. Furthermore, it is disadvantageous that the slag jet cannot be seized by the gas exhaust hood entirely and the metal melt surface lies bare even in the transport vessel so that dust and flue gases continue to constitute a load during slagging.

The invention aims at avoiding these disadvantages and difficulties and has as its object to provide a ladle slagging stand of the initially defined kind, in which all the gas and dust emissions forming during the slagging procedure can be seized at a low suction performance only.

In accordance with the invention, this object is achieved in that both the tilting means and the slagging slide, and the slag vessel are surrounded by a casing into which a suction duct enters, and that the casing includes at least one closeable opening for introducing and removing the ladle and the slag vessel.

In order to be able to do with a casing as small as possible, the slagging slide advantageously is connected with an actuation means arranged outside of the casing by means of an extension arm, which extension arm projects into the interior of the casing through an opening provided in the same.

In order to ensure the easy installation of the ladle in the tilting means, the casing suitably is formed by a stationary lower part and an upper part that is removable from the lower part under release of the tilting means, wherein the removable upper part advantageously comprises an approximately horizontally directed ceiling part and a side wall part extending downwards from the ceiling part on one side.

A preferred, particularly compact embodiment is characterized in that the upper part is displaceable along horizontally arranged rails, one rail being provided to support the ceiling part near the free edge of the ceiling part and a further rail being provided to support the side wall part near the lower edge of the side wall part.

In order to be able to open and close the casing at any time, the stationary lower part of the casing advantageously includes an opening for the actuation means of the slagging slide.

Preferably, the removable upper part is provided with an exhaust opening, such as an exhaust socket, which follows upon a stationary exhaust duct with the casing closed, the casing, thus, being automatically connected to the exhaust duct in the closed state.

Suitably, the removable upper part is provided with a sampling and/or measuring probe means such that the sampling and/or measuring probe means are, with the casing closed, is automatically placed in the right position without having to open the casing therefor.

In order to reduce the evacuation of false air, an optical teletransmission means advantageously is provided for observance of the slagging procedure.

To further reduce the suction of false air, the stationary lower part of the casing, according to a preferred embodiment, is provided with a closeable opening through which the slag vessel can be moved and the actuation means of the slagging slide advantageously is arranged within the casing.

The invention will now be explained in more detail by way of the exemplary embodiments illustrated in the accompanying drawings, wherein.

Figure 1:
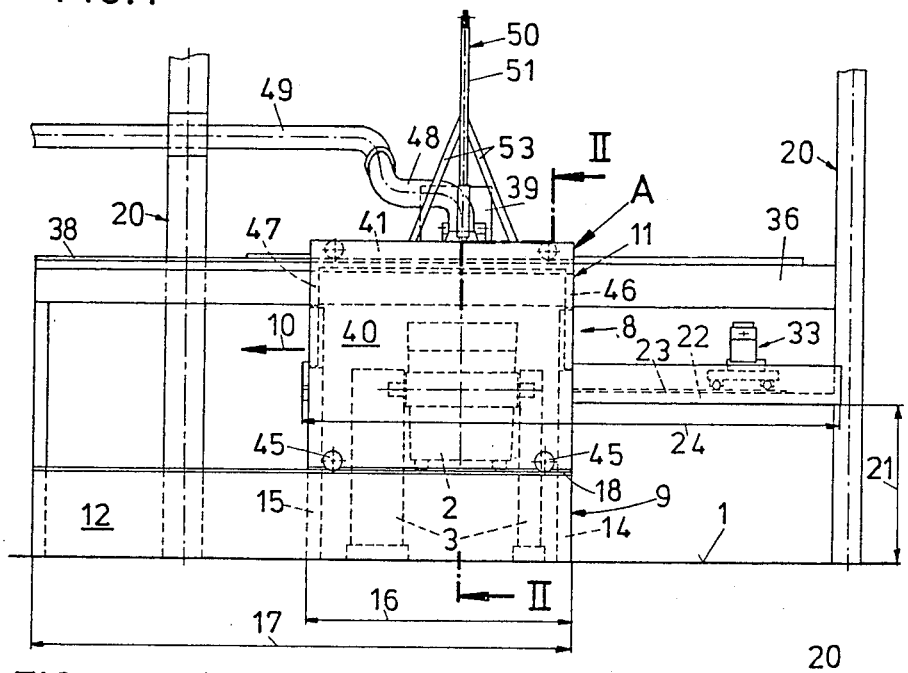
FIG. 1 is a ladle slagging stand in the side view.
Figure 3:
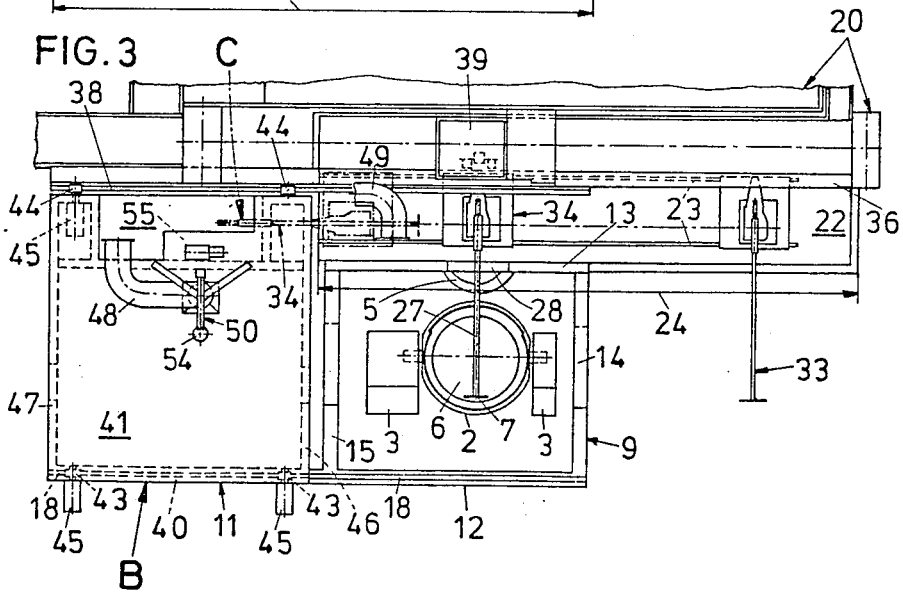
FIG. 3 is a top view onto the ladle slagging stand with the casing opened.
Figure 2:
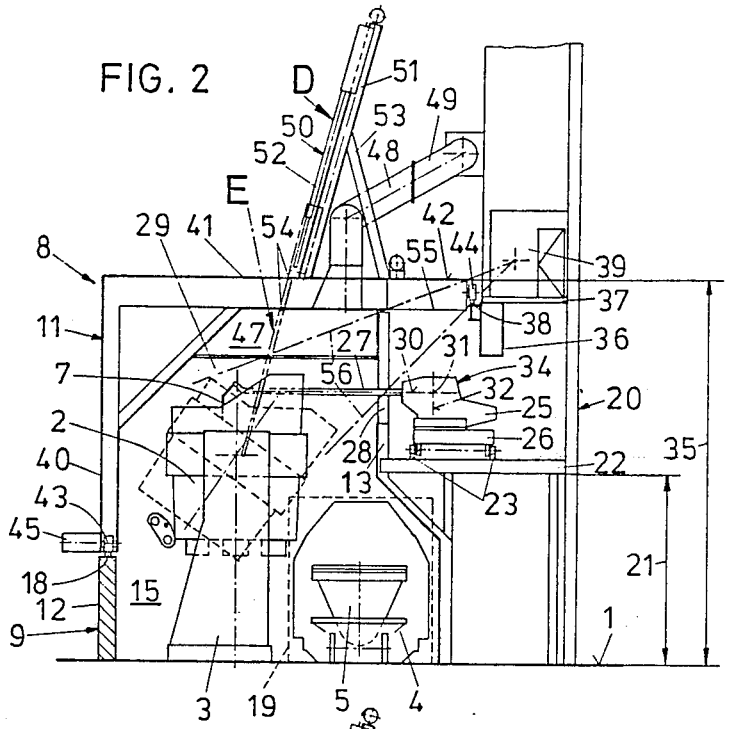
FIG. 2 is a section along line II—II of FIG. 1.

According to FIGS. 1 to 3, the ladle slagging stand is shown to include a tilting means 3 arranged on a mill floor 1 and supporting a ladle 2. Closely beside the tilting means 3, there is positioned a slag vessel 5 placed on a carriage 4, which is displaceable on the mill floor 1. Approximately at the level of the mouth of the ladle 2 placed on the tilting means 3, a slagging slide 7 is provided to scum the surface of the melt 6.

The tilting means 3, the slagging slide 7 and even the slag vessel 5 are surrounded by a common casing 8, which comprises a lower part 9 stationarily arranged on the mill floor 1 and an upper part 11 movable from the stationary lower part 9 in a direction illustrated by arrow 10, from a position A (cf. FIG. 1), in which the casing is closed, into a position B (cf. FIG. 3). By separating the upper part 11 from the lower part 9, the tilting means 3 is released towards above and towards one side such that a ladle exchange by means of a crane is feasible.

The stationary lower part 9 is formed by a low vertical supporting wall 12 directed in the moving direction of the upper part 11, a considerably higher side wall 13 arranged opposite of, and directed parallel to, the supporting wall 12, and end walls 14, 15 provided between the side wall 13 and the supporting wall 12 and directed normal to the moving direction of the upper part 11. The length 16 of the side wall 13 corresponds to the dimension of the removable upper part 11 in the direction of this side wall 13, whereas the supporting wall 12 is designed to be extended beyond the region of the casing 8, thus having approximately twice the length 17 of the side wall 13.

To the upper end of the supporting wall 12, a horizontally extending rail 18 is fastened, covering the total length 17 of the supporting wall 12. At least one of the two end walls 14, 15 includes an opening to be closed by a door 19 for the introduction and removal of the slag vessel 5.

Beside the casing 8, a trestlework 20 connected with the side wall 13 of the lower part 9 and extending beyond the longitudinal extension of the casing 8 is provided. At approximately half the height 21 of the casing 8, the trestlework 20 carries a working platform 22, on whose upper side guide rails 23 are arranged so as to be directed parallel to the rail 18 provided on the upper end of the supporting wall 12, extending nearly over the entire length 24 of the working platform 22. A sled 26 carrying an actuation means 25 for the slagging slide 7 is guided on the guide rails 23, thus being displaceable along the working platform 22 parallel to the moving direction of the upper part 11.

The actuation means 25 is connected with the slag slide 7 by an extension arm 27, which projects into the interior 29 of the casing 8 through an opening 28 provided in the side wall 13 above the working platform 22. The extension arm 27 is arranged on the actuation means 25 so as to be movable in the direction of its longitudinal axis 30. Furthermore, the extension arm 27 is pivotable about a horizontal axis 31 directed in the moving direction of the upper part 11 and laid through the actuation means 25, and about a vertical axis 32 directed normal to the horizontal axis 31. Thus, the slagging slide 7 is movable into any desired position.

A spare device 33 for the unit 34 comprised of slagging slide 7, extension arm 27, actuation means 25 and sled 26 is displaceably arranged on the guide rails 23 of the working platform 22 beside the casing 8. In case of a defect of the unit 34, the latter is removed from the region of the tilting means 3 and is moved into a position C illustrated in dot-and-dash lines, and the spare device 33 is positioned in the region of the tilting means.

Above the working platform 22, there is arranged a longitudinal girder 36 extending over the entire length 17 of the trestlework 20 and supporting an upper platform 37 arranged approximately at the level 35 of the casing 8. To the side of the longitudinal girder 36 facing the casing 8, there is fastened a rail 38 directed horizontal and parallel to the rail 18 provided on the supporting wall 12 and whose length corresponds to the rail 18 mounted on the supporting wall 12. A directing stand is provided on the upper platform 37 in the region of the tilting means 3.

A side wall part 40 of the removable upper part 11, that extends the supporting wall 12 towards above is arranged opposite the side wall 13. In addition, the upper part 11 of the casing 8 comprises a ceiling part 41 arranged horizontally at the height of the upper platform 37, which ceiling part, on one side, is connected with the side wall part 40 and, with its opposite, free end 42, overlaps the side wall 13 of the stationary lower part 9. The upper part 11 is movable along the rails 18, 38 by means of wheels 43, 44, two of which are arranged on the free end 42 of the ceiling part 41 and two of which are arranged on the lower edge of the side wall part 40, by the aid of driving motors 45 flanged to the axles of the wheels.

The upper part 11, on its end-side ends, includes end wall parts 46, 47 directed normal to its moving direction and completing the end walls 14, 15 of the stationary lower part 9 with the casing 8 closed.

An exhaust socket 48 is provided on the ceiling part 41 of the upper part 11 and communicates with a stationary exhaust duct 49 in the position A of the upper part 11, i.e., with the casing 8 closed. In addition, a sampling and/or measuring probe means 50 is arranged on the ceiling part 41, which is formed by a guide 51 rigidly fastened to the ceiling part 41 and by a probe 52 movably mounted on the same. The guide 51 is inclined relative to the vertical line and abuts on the ceiling part 41 by means of two legs 53. The probe 52 is movable in the axial direction, from a resting position D illustrated in full lines into an operating position E entered in dot-and-dash lines, wherein, in the operating position E, the probe projects into the interior 29 of the casing 8 through an opening 54 provided in the ceiling part 41 and immerses into the ladle 2 filled with melt 6 with its free end.

On the free end 42 of the ceiling part 41 overlapping the side wall 13 of the stationary lower part 9, there is provided a recess 55, which forms an inspection window with the opening 28 provided in the side wall 13, thus providing for a visible area that is delimited by dot-and-dash lines 56 and which enables a good surveillance of the slagging procedure from the directing stand 39 with the casing 8 closed.

The arrangement according to the invention functions in the following way:

Installation of the ladle 2 into the tilting means 3 is effected by means of a mill crane (not illustrated) with the casing 8 opened, thus ensuring a good view on the tilting means 3 to the crane man and hence the simple insertion of the ladle 2. Upon closure of the casing 8, the removal of the slag floating on the melt 6 takes place by means of the slagging slide 7.

To this end, the ladle 2 is pivoted into the broken-line position by a certain extent corresponding to the height of the melt meniscus in order that the slag seized by the slagging slide 7 is able to flow into the slag vessel 5. The extension arm 27 is pivoted about the horizontal axis 31 in accordance with the position of the ladle 2. The gas and dust emissions forming during the slagging procedure are completely removable by means of the stationary exhaust duct 49, which is automatically connected with the exhaust socket 48 as the casing 8 is closed. In doing so, only a slight suction performance is required, because the suction of larger amounts of false air through the casing 8, which is closed except for the recess 55 in the ceiling part 41 and the opening 28 for the extension arm 27, is avoided.

After having removed the slag, the slag vessel 5 is moved out of the casing upon opening of the door 19 provided in the end wall 15 of the stationary lower part 9. With the help of the probe 52, samples may be taken from the melt bath 6 and the temperature of the melt may be measured. The control of the sampling and/or measuring probe means 50 is effected from the directing stand 39. After the gas and dust emissions have been eliminated completely, the casing 8 may be re-opened by removing the upper part 11, the exhaust duct 48, thus, being automatically separated from the exhaust socket 49.

Figure 4:
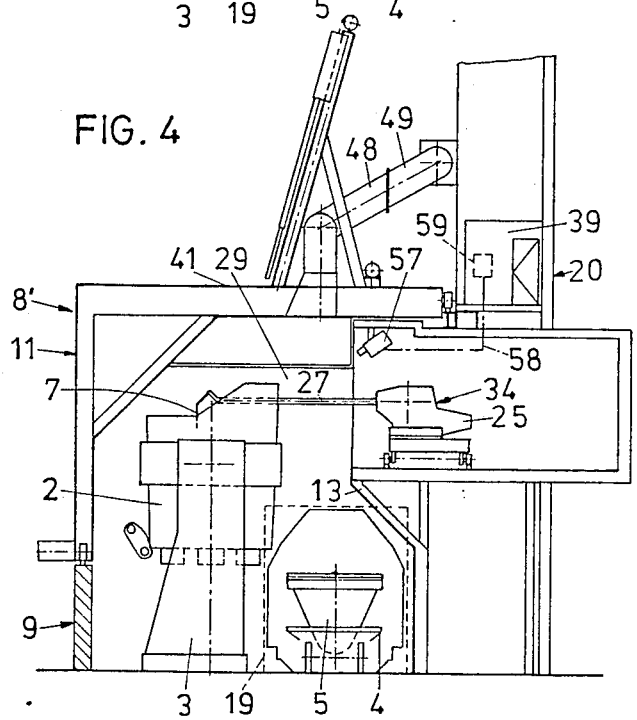
FIG. 4 represents a further embodiment in an illustration analogous to FIG. 2.

In FIG. 4, another embodiment of the arrangement according to the invention is illustrated, in which the actuation means 25 of the slagging slide 7 is arranged within the casing 8'. Hence, the opening for the extension arm 27 of the actuation means 25 in the side wall 13 of the stationary lower part 9 has been omitted. Moreover, a video camera 57 is provided in the interior 29 of the casing 8' for optical teletransmission, comprising a video circuit 58 leading to the directing stand and connected with a screen 59 provided in the directing stand 39; thereby, also the inspection window 28, 55 in the ceiling part 41 and in the side wall 13 has been omitted and the suction of false air in the completely closed casing 8' is avoided nearly completely. In addition to minimizing the amount of false air aspirated, it is also possible to keep the gas volume to be sucked off very small by selectively arranging intake air canals in the casing 8'.

The invention is not limited to the exemplary embodiments illustrated in the drawings, but may be modified in various aspects. It is, for instance, possible to arrange the exhaust duct 49 in the stationary lower part 9 of the casing 8 or 8'. Furthermore, the casing may have any form other than that illustrated in the exemplary embodiments, depending on the respective operational requirements.

What I claim is:

1. In a slagging stand including a ladle containing a melt having a melt surface with a lag layer thereon, a tilting means supporting said ladle, a slag vessel, a slagging slide device for skimming said melt surface in said ladle while said ladle is supported by said tilting means, the improvement which comprises:

a casing surrounding and enclosing said tilting means, said slagging slide device and said slag vessel, said casing being comprised of a stationary lower part and of a movable mounted upper part directly above said stationary lower part and capable of being moved laterally from said lower part to enable the removal or the introduction of said ladle, said upper part having an exhaust duct communicating therewith capable of being connected to a stationary duct located outside of said casing, a closable opening in said casing to enable the introduction and removal of said slag vessel, and actuation means disposed relative to said casing for actuating said slagging slide device via an extension arm extending from said actuation means and connected to said slagging slide device, said extension arm entering the interior of said casing which houses both said ladle and said slag vessel.

2. A ladle slagging stand as set forth in claim 1, wherein said removable upper part of said casing comprises a ceiling part directed approximately horizontal and a side wall part extending downward from said ceiling part on one side thereof.

3. A ladle slagging stand as set forth in claim 2, further comprising horizontally arranged rail means cooperably associated with the upper part of said casing for movement of said upper part of said casing therealong, one of said rail means being provided to support said ceiling part near its free edge and one of said rail means being provided to support said side wall part near its lower edge.

4. A ladle slagging stand as set forth in claim 1, further comprising at least one sampling means and measuring probe means cooperably associated with said removably upper part of said casing.

5. A ladle slagging stand as set forth in claim 1, further comprising an optical teletransmission means cooperably associated with the interior of said casing to enable surveillance of the slagging procedure.

6. A ladle slagging stand as set forth in claim 1, wherein said stationary lower part of said casing has a closeable opening to enable the passage of said slag vessel therethrough.

* * * * *